US007917989B2

(12) United States Patent
Deerberg et al.

(10) Patent No.: US 7,917,989 B2
(45) Date of Patent: Apr. 5, 2011

(54) MOP SYSTEM, WRINGER DEVICE AND MOP

(75) Inventors: Jens Deerberg, Essen (DE); Andreas Eisenhut, Heidelberg (DE); Torsten Gratzki, Essen (DE)

(73) Assignee: Carl Freudenberg KG, Weinheim (DE)

( * ) Notice: Subject to any disclaimer, the term of this patent is extended or adjusted under 35 U.S.C. 154(b) by 910 days.

(21) Appl. No.: 11/597,175

(22) PCT Filed: Mar. 16, 2005

(86) PCT No.: PCT/EP2005/002780
§ 371 (c)(1),
(2), (4) Date: Mar. 26, 2007

(87) PCT Pub. No.: WO2005/117680
PCT Pub. Date: Dec. 15, 2005

(65) Prior Publication Data

US 2008/0098548 A1 May 1, 2008

(30) Foreign Application Priority Data

May 28, 2004 (DE) ..... 10 2004 026 837

(51) Int. Cl.
*A47L 13/58* (2006.01)

(52) U.S. Cl. ..... 15/260; 15/261

(58) Field of Classification Search ..... 15/260, 15/262, 229.3, 229.7, 228, 229.6, 261
See application file for complete search history.

(56) References Cited

U.S. PATENT DOCUMENTS

| | | | | |
|---|---|---|---|---|
| 4,912,804 | A * | 4/1990 | Pasbol | 15/262 |
| 2003/0046782 | A1 * | 3/2003 | Kresse et al. | 15/229.8 |
| 2003/0056315 | A1 * | 3/2003 | Salmon | 15/261 |
| 2003/0167589 | A1 | 9/2003 | Dingert et al. | |

FOREIGN PATENT DOCUMENTS

| | | | |
|---|---|---|---|
| CN | 2189899 | Y | 2/1995 |
| DE | 43 18 792 | A1 | 12/1994 |
| DE | 10019211 | A1 | 9/2001 |
| EP | 0 426 209 | A1 | 5/1991 |
| EP | 0 787 461 | A2 | 8/1997 |
| EP | 0 808 601 | A2 | 11/1997 |
| EP | 1 147 735 | A2 | 10/2001 |
| EP | 1 234 537 | A2 | 8/2002 |

* cited by examiner

*Primary Examiner* — Shay L Karls
(74) *Attorney, Agent, or Firm* — Leydig, Voit & Mayer, Ltd.

(57) ABSTRACT

The invention relates to a mop (1) comprising a mop-head plate (2) for a mop cover (3). The mop-head plate (2) comprises a first connector (4), which can be connected to at least one second connector (5) of a wringer device (6) in order to wring out the mop cover (3). The invention also relates to a wringer device (6) for a mop (1) comprising a mop-head plate (2) for a mop cover (3), said plate having two folding mop-head plate parts (7, 8). Said wringer device (6) comprises a funnel-shaped wringer compartment (22). The mop cover (3) can be introduced into said compartment from above and compressed by actuating the wringer device, when the mop-head plate parts (7, 8) are in an essentially vertical position and said cover is partially detached and suspended from said parts. The opposing transversal surfaces (10, 11) of the mop-head plate parts (7, 8) form compression surfaces. The wringer device (6) comprises a lever unit (23) with the second connector (5), said lever unit consisting of an actuating lever (24) and a pressure lever (25) that is connected to the actuating lever (24). The pressure lever (25) forms the second connector (5) and can be connected to the first connector (4).

13 Claims, 6 Drawing Sheets

MOP SYSTEM, WRINGER DEVICE AND MOP

TECHNICAL FIELD

The invention concerns a mop with a mop plate for a mop cover, a wringer device for a mop with a mop plate for a mop cover, where the mop plate consists of two folding mop plate sections, where the wringer device has a funnel-shaped wringer shaft, in which the mop cover, with the mop plate sections in an essentially vertical position, partially separated from said sections and hanging downward, can be inserted from above and squeezed out by actuating the wringer device, where the transverse sides of the mop plate sections that are opposite each other form pressure surfaces, and a mop system.

PRIOR ART

Mops with a mop plate for a mop cover, where the mop cover can be wrung out in a wringer device, are generally known.

A wringer device for a mop is known from DE 44 33 001. The mop consists of a plate-shaped mop plate, on which a mop cover is stretched. To squeeze out the mop cover, the mop plate with the stretched mop cover can be positioned on a sieve-like bearing surface. By means of a pressure lever, which acts on the side of the mop plate turned away from the mop cover, the mop cover can be wrung out. It is disadvantageous with this wringer device that the pressure per unit of surface area is low and, because of that, the amount of residual moisture remaining in the mop cover is high. High residual moisture is to be avoided in particular when cleaning sensitive floors.

DESCRIPTION OF THE INVENTION

The invention is based on the task of making further developments in the known mop system to the extent that the mop cover can be wrung out easily without touching it and that only a small amount of residual moisture remains in the mop cover.

To achieve the task, the mop plate of the mop has at least one first connection element which can be brought into engagement with at least one second connection element of a wringer device for wringing out the mop cover.

The connection device, which is arranged directly on the mop plate, enables reliable transfer of the forces necessary for wringing out the mop cover. In contrast to the input of force via the handle, in which the force is conveyed via the hinge between the mop and mop plate, higher forces can be introduced. There is no danger that the handle can tip out, for example, via the hinge. The mop cover can be efficiently wrung out. Due to the potentially high wringer forces, only a small amount of residual moisture remains in the mop cover after the wringing operation. The lever enables good delivery of the compressive force.

The mop plate can consist of two mop plate sections and, looking essentially centrally in the lengthwise direction, can have a hinge extending across or parallel to the lengthwise axis of the mop plate which foldably connects the two mop plate sections to each other. Through the folding together of the mop plate, the mop cover can be at least partially separated from the mop plate. The mop cover can then be wrung out especially efficiently, since the mop cover can be compressed in a wringer device similar to when it is wrung out by hand.

The mop plate sections can each have at least one attachment device for attaching the mop cover on their transverse sides that are turned away from each other. Through the attachment of the mop cover to the transverse sides of the mop plate, the mop cover hangs vertically downward when the plate sections are folded together, without separating from the mop plate. The mop cover can then be easily inserted into a funnel-shaped wringer device to be wrung out.

Each of the mop plate sections can have at least one connection element. Through this, the alignment of the mop plate in order to bring the first connection element into engagement with the second connection element can be omitted. The wringing operation can be additionally sped up because of this.

In one embodiment, the first connection element can be formed by a recess in the side of the mop plate turned away from the mop cover or by a hole through the mop plate. Through the holes or recesses, mop plates of different sizes, especially different lengths, can be wrung out in a wringer device, since the holes or recesses can be arranged to be always at the same distance from the center line or the outer (the lower in the folded state) transverse edges.

In another embodiment, the first connection element can be formed by the transverse sides of the mop plate sections that are turned toward each other, which form pressure surfaces for the second connection element in the folded state. This arrangement of the pressure surfaces of the wringer device enables the use of traditional double plate wringer devices in connection with the wringer device.

The first connection element can be formed by a body that is arranged on the side of the mop plate that is turned away from the mop cover and that projects beyond the mop plate. The body is easily applied to a mop plate. Through the body, mop plates of different sizes can be wrung out in the same wringer device, since the body can always be arranged at an equal distance to the center line or the outer transverse edges.

In another embodiment, the first connection element can be formed by at least one projecting part that is arranged on a lengthwise edge of the mop plate. Reliable engagement of the two connection elements takes place due to the projecting parts.

The task is additionally solved by a wringer device for a mop with a mop plate for a mop cover in which the wringer device has a lever arrangement with the second connection element including an actuating lever and a pressure lever connected to the actuating lever, where the pressure lever forms the second connection element and can be brought into engagement with the first connection element.

The wringer device is simply and stably organized and has only a few moving parts. Through the engagement of the connection element of the wringer device directly on the mop plate, reliable wringing takes place, and only a small amount of residual moisture remains in the mop plate. The wringer device therefore is very well suited for professional use.

The transfer of power from the actuating lever to the pressure lever takes place without an intermediate hinge, so the lever arrangement is very robust. The mop cover is compressed to a very low residual moisture content when it is wrung out through the funnel-shaped wringer sieve.

In one embodiment, the second and the first connection elements can be engaged by friction fit. The friction fit connection makes it also possible to wring out in the wringer mops that are not explicitly fitted for this. The first connection element can be formed, for example, by the surface of the mop plate turned away from the mop surface.

In another embodiment, the second and the first connection elements can be connected by a form fit (positive locking fit).

A reliable connection results from the form fit connection, through which the force of the compression lever can be reliably transmitted for wringing.

To solve the task, the mop described above is combined with the described wringer device to form a mop system.

BRIEF DESCRIPTION OF DRAWINGS

Some embodiments of the mop in accordance with the invention and the wringer device in accordance with the invention are explained in more detail below by means of the figures. Here, in each case in a schematic representation.

EXPLANATION OF THE INVENTION

Figure 1:
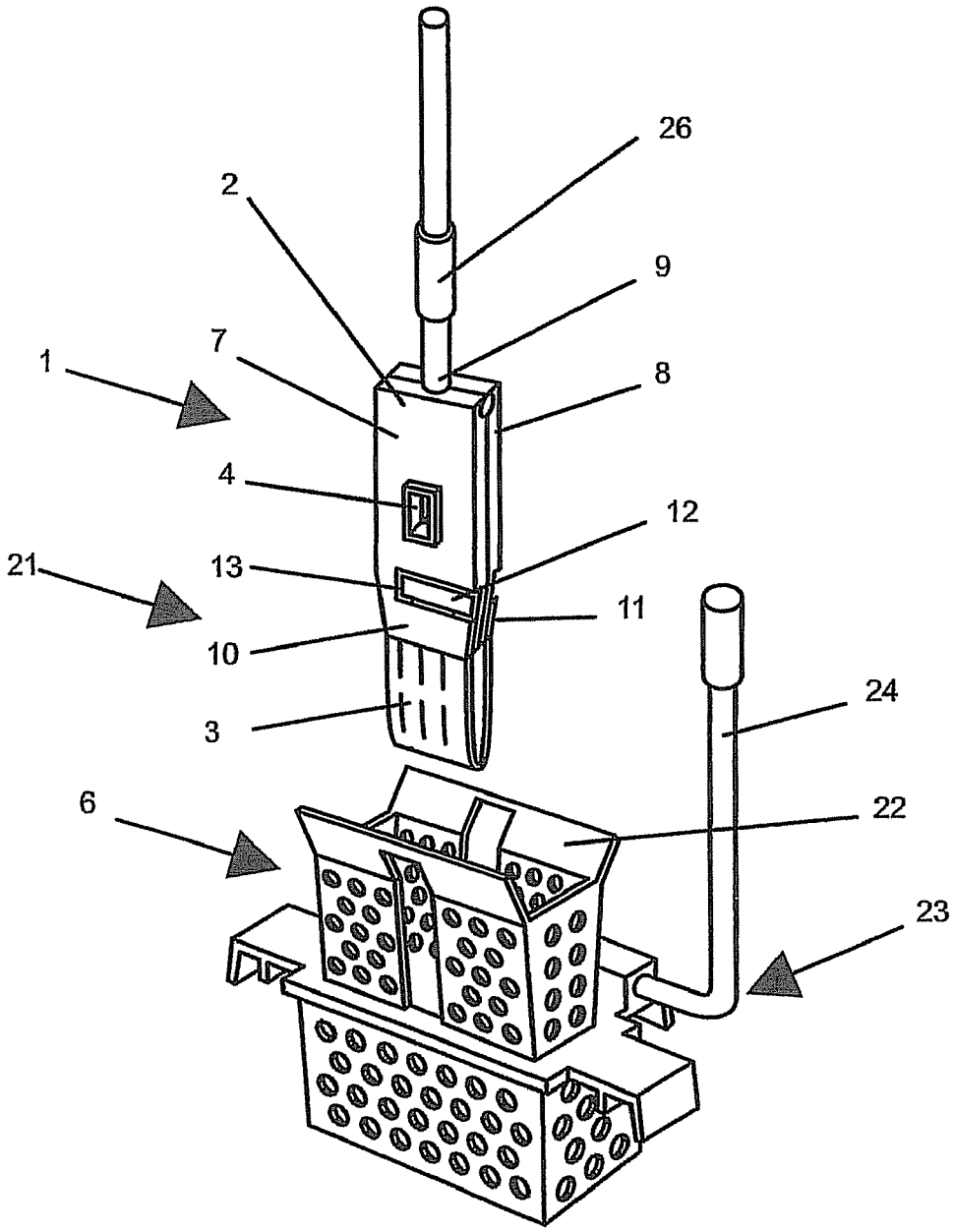
FIG. 1 shows a mop system in accordance with the invention consisting of a mop and wringer device.

FIG. 1 shows a mop system 21 with a mop 1 and a wringer device 6. The mop 1 has a mop plate 2 for a mop cover 3, where the mop plate 2 is connected to handle 26 by a hinge. The mop plate 2 consists of two mop plate sections 7 and 8 and has, looking lengthwise, a hinge 9 extending centrally across the lengthwise axis of mop plate 2. Hinge 9 connects the two hinge plate sections 7 and 8 so that they can fold relative to each other. The hinge plate sections 7 and 8 each have an attachment device 12 for attaching the mop cover 3 on the transverse sides 10 and 11 that are turned away from each other. Both mop plate sections 7 and 8 of mop plate 2 have a first connection element 4. In this embodiment, the first connection element 4 is formed by a recess 13. The recess 13 can be brought into engagement with the second connection element 5 of the wringer device 6.

The wringer device 6 for the mop 1 has a funnel-shaped wringer shaft 22, in which the mop cover 3 can be inserted from above when the mop plate sections 7 and 8 are in essentially vertical position and the mop cover is partially separated from them and hangs downward. By actuating the wringer device 6, the mop cover 3 is compressed. The transverse sides 10 and 11 of the mop plate sections 7 and 8 that are turned away from each other form bearing surfaces. A lever device is movably connected to the wringer shaft 22. The lever device 23 has the second connection device 5. The lever device 23 is composed of an actuating lever 24 and a pressure lever 25 that is connected to the actuating lever 24. The pressure lever 25 forms the second connection element 5, which can be brought into engagement with the first connection element 4 in a form fit.

Figure 2:
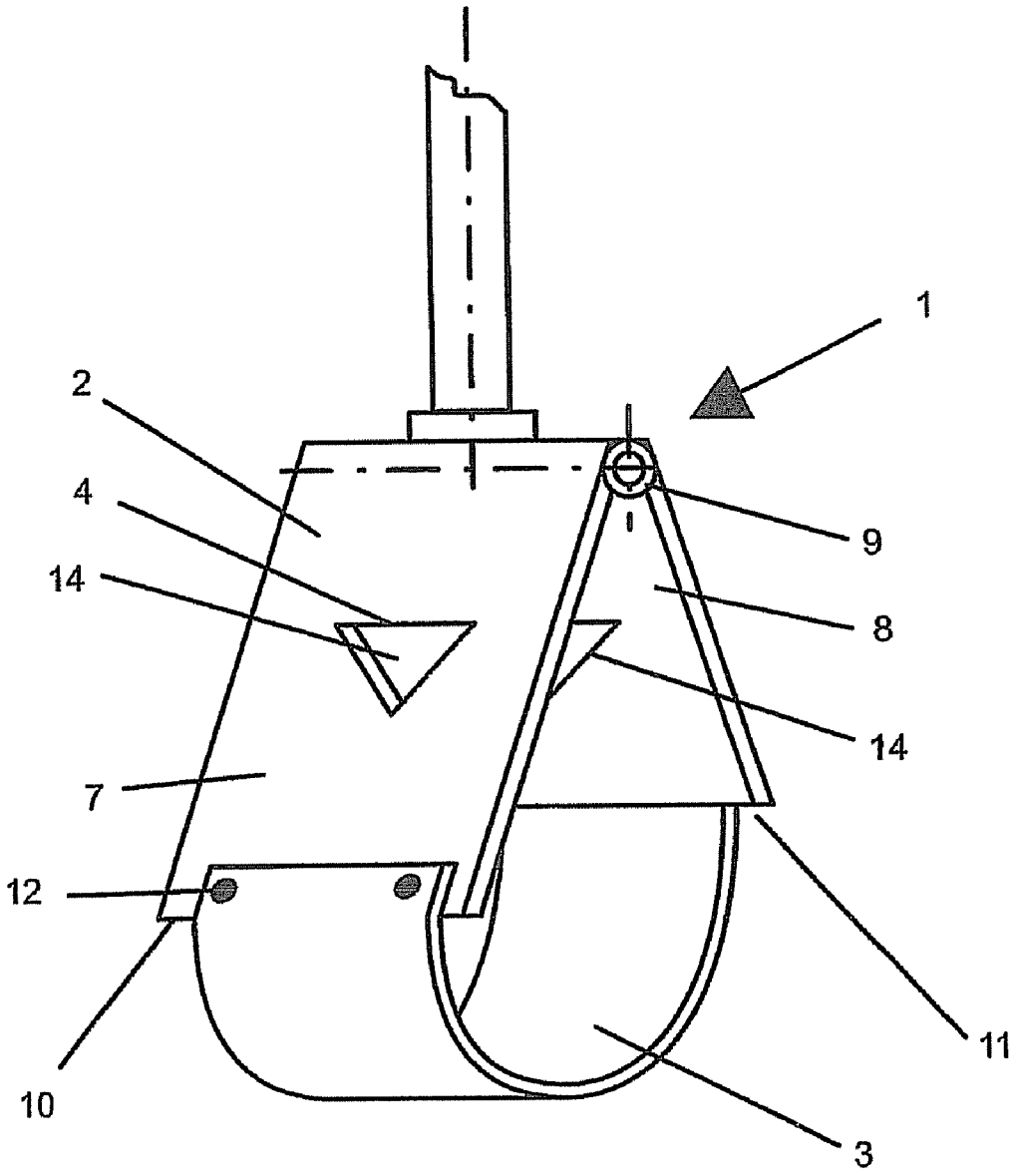
FIG. 2 shows a mop with a recess as first connection element.

FIG. 2 shows a mop 1 with a mop plate 2 for a mop cover 3. The mop plate 2 is composed of two mop plate sections 7 and 8 and has, looking in the lengthwise direction, a hinge 9 extending centrally across the lengthwise axis of the mop plate 2. Hinge 9 foldably connects the two mop plate sections 7 and 8 to each other. The mop plate sections each have an attachment device 12 for attaching the mop cover 3 on their transverse sides 10 and 11 that are turned away from each other. Both mop plate sections 7 and 8 of mop plate 2 have a first connection device 4. In this embodiment, the first connection device 4 is formed by a hole 14. The hole 14 can be brought into engagement with the second connection device 5 of the wringer device 6 in a form fit.

Figure 3:
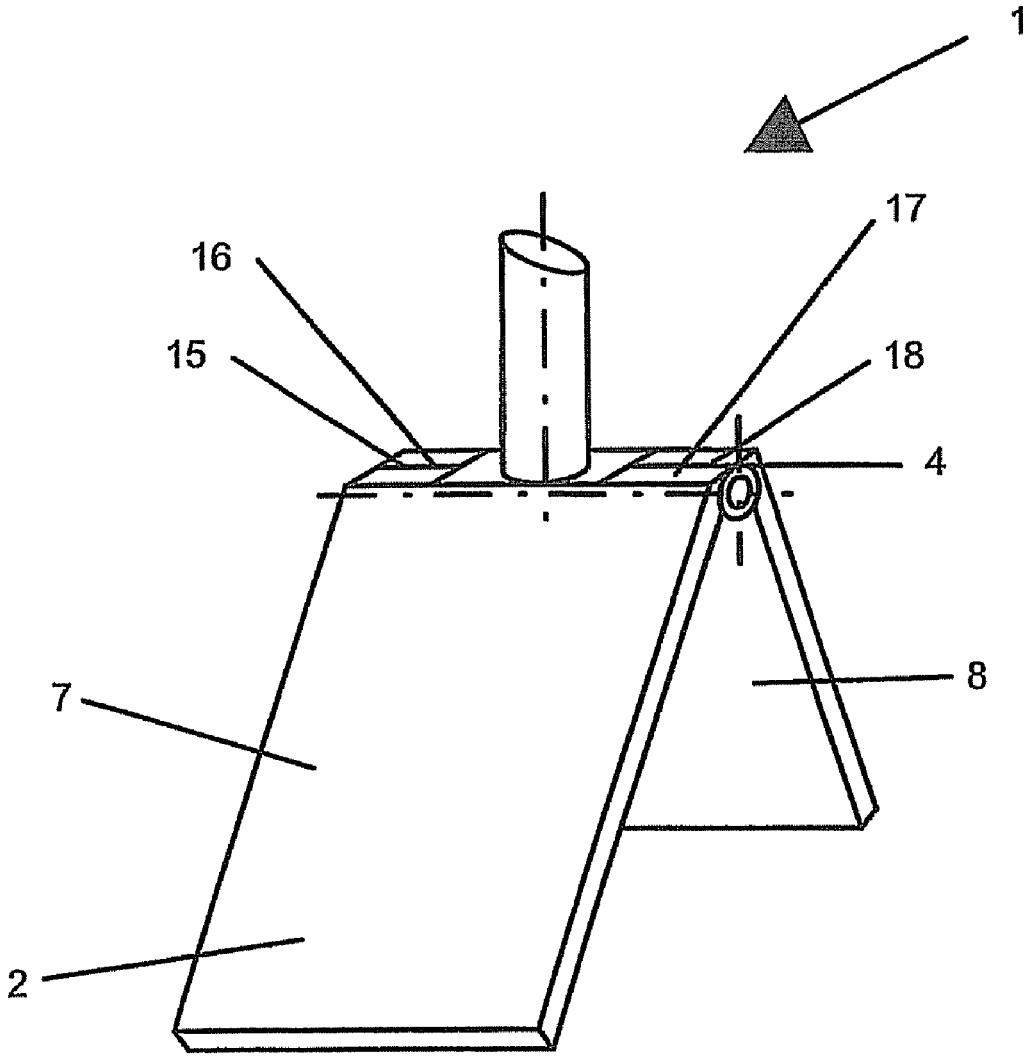
FIG. 3 shows a mop with a bearing surface on the transverse sides of the mop plate sections turned toward each other as the first connection element.

FIG. 3 shows a mop 1 as in FIG. 2, where the first connection device 4 is formed by the transverse sides 15 and 16 of the mop plate section 7 and 8 that are turned toward each other, which, when mop plate 2 is in folded state form pressure surfaces 17 and 18 for the second connection element 5.

Figure 4:
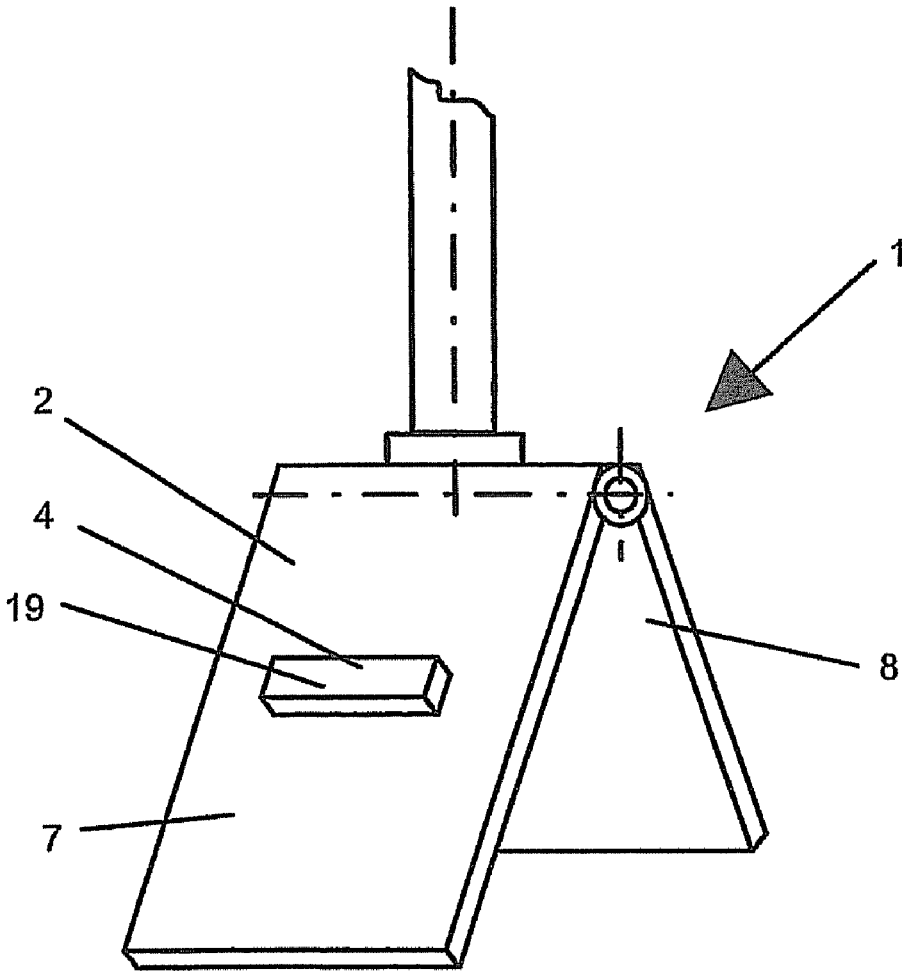
FIG. 4 shows a mop with a block as first connecting element.

FIG. 4 shows a mop as in FIG. 2, where the first connection element 4 is formed by a body 19, which is arranged on the side of the mop plate 2 that is turned away from the mop cover 3 and which projects beyond the surface of the mop plate 2.

Figure 5:
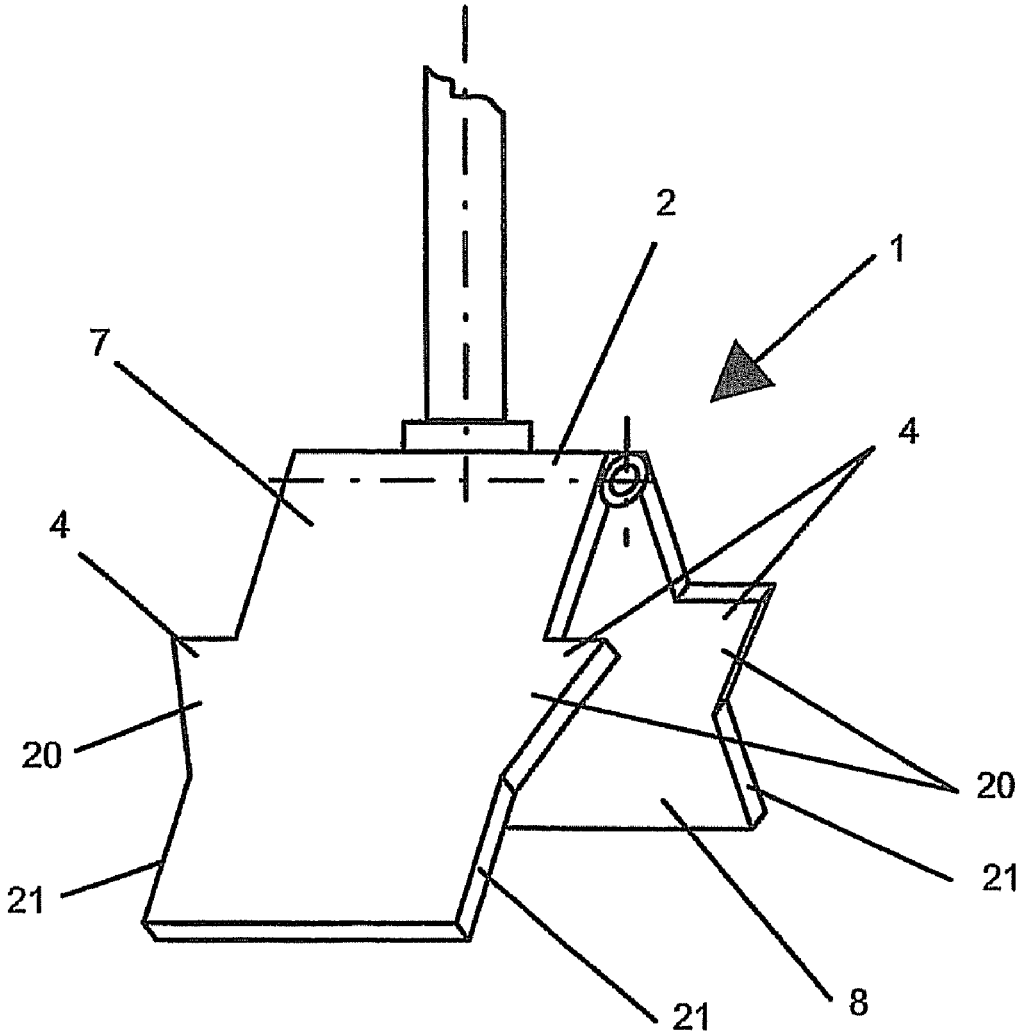
FIG. 5 shows a mop with projections on the lengthwise sides as first connection element.

FIG. 5 shows a mop as in FIG. 2, where the first connection element 4 is formed by at least one projecting part 20, which is arranged on a long edge 21 of mop plate 2.

Figure 6:
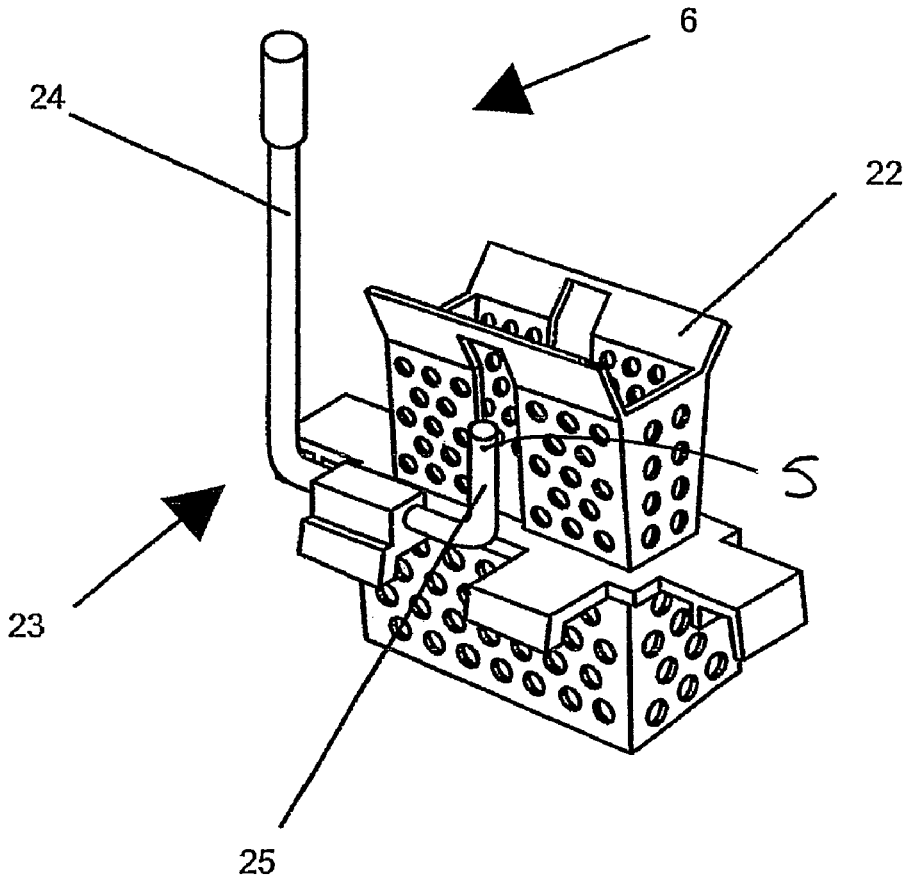
FIG. 6 shows a wringer device in accordance with the invention.

FIG. 6 shows a wringer device for a mop 1 with a funnel-shaped wringer shaft 22, in which the mop cover 3 can be inserted from above. By actuating the wringer device 6, the mop cover 3 is compressed. A lever device 23 is movably connected to the wringer shaft 22, directly or indirectly. The lever element 23 has the second connection element 5. The lever device 23 is composed of an actuating lever 24 and a pressure lever 25 connected to the actuating lever 24. The pressure lever 25 forms the second connection element 5 of a connection element of a mop plate can be brought into engagement.

The invention claimed is:

1. A mop comprising a mop plate for a mop cover, the mop plate has at least one first connection element which can be brought into engagement with at least one second connection element of a wringer device so as to define a mechanical connection therebetween, the mechanical connection enabling a wringing force input through the wringer device to be transferred to the mop plate through the mechanical connection in order to wring out the mop cover.

2. A mop as in claim 1, wherein the mop plate consists of two mop plate sections and, looking lengthwise, has essentially centrally a hinge extending transversely or parallel to the lengthwise axis of the mop plate, which foldably connects the two mop plate sections to each other.

3. A mop as in claim 2, wherein the mop plate sections have at least one attachment device for attachment of the mop cover on their transverse sides that are opposite each other.

4. A mop as in claim 2 wherein each of the mop plate sections have at least one first connection element.

5. A mop as in one of claim 2, wherein the first connection element is formed by the transverse sides of the mop plate sections that are opposite each other, which in folded state form pressure surfaces for the second connection element.

6. A mop as in claim 1 wherein the first connection element formed by a recess in the side of the mop plate opposite the mop cover.

7. A mop as in claim 1, wherein the first connection element is formed by a body which is arranged on the side of the mop plate away from the mop cover and projects beyond the mop plate.

8. A wringer device as in claim 7, wherein the first connection elements can be brought into engagement in a friction fit.

9. A wringer device as in claim 7, wherein the first connection elements can be brought into engagement in a form fit.

10. A mop as in claim 1, wherein the first connection element is formed by at least one projection which is arranged on a lengthwise edge of the mop plate.

11. A mop as in claim 1, wherein the first connection element is formed by a hole through the mop plate.

12. A wringer device for a mop with a mop plate for a mop cover, in which the mop plate includes two foldable mop plate sections and a first connection element, the mop plate having opposed transverse sides, the wringer device comprising a funnel-shaped wringer shaft, in which the mop cover can be inserted from above when the mop plate sections are in an essentially vertical position and the mop cover is separated from the mop plate sections and hangs downward therefrom, the wringer device being configured such that when inserted therein the mop cover can be squeezed out by actuating the wringer device with the opposing transverse sides of the mop plate forming pressure surfaces for the squeezing out of the mop cover, the wringer device having a lever device including an actuating lever and a pressure lever connected to the actuating lever, where the pressure lever forms a second connection element and can be brought into engagement with the first connection element for enabling a wringing force input through the actuating lever of the wringer device to be transferred to the mop plate in order to squeeze out the mop cover.

13. A mop system comprising a mop and a wringer device, the mop includes a mop plate for a mop cover, the mop plate has at least one first connection element which can be brought into engagement with at least one second connection element of the wringer device for wringing out the mop cover, the mop plate includes two foldable mop plate sections and opposed transverse sides, the wringer device includes a funnel-shaped wringer shaft, in which the mop cover can be inserted from above when the mop plate sections are in an essentially vertical position and the mop cover is separated from the mop plate sections and hangs downward therefrom, the wringer device being configured such that when inserted therein the mop cover can be squeezed out by actuating the wringer device with the transverse sides of the mop plate forming pressure surfaces for squeezing out the mop cover, the wringer device has an actuating lever and a pressure lever connected to the actuating lever, where the pressure lever forms the second connection element and can be brought into engagement with the first connection element for enabling a wringing force input through the actuating lever of the wringer device to be transferred to the mop plate in order to squeeze out the mop cover.

* * * * *